US007108398B2

(12) United States Patent
Holten

(10) Patent No.: US 7,108,398 B2
(45) Date of Patent: Sep. 19, 2006

(54) LUMINAIRE AND LAMELLAE GRID

(75) Inventor: Petrus Adrianus Josephus Holten, Winterswijk (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 219 days.

(21) Appl. No.: 10/493,795

(22) PCT Filed: Oct. 18, 2002

(86) PCT No.: PCT/IB02/04340

§ 371 (c)(1),
(2), (4) Date: Apr. 27, 2004

(87) PCT Pub. No.: WO03/038336

PCT Pub. Date: May 8, 2003

(65) Prior Publication Data

US 2004/0252510 A1 Dec. 16, 2004

(30) Foreign Application Priority Data

Nov. 1, 2001 (EP) ..... 01204202

(51) Int. Cl.
*F21V 11/16* (2006.01)

(52) U.S. Cl. ..... 362/292; 362/223; 362/260; 362/301; 362/342; 362/346; 362/354

(58) Field of Classification Search ..... 362/354, 362/217, 223–224, 260, 290–292, 296–301, 362/307–311, 330, 341–342, 346
See application file for complete search history.

(56) References Cited

U.S. PATENT DOCUMENTS

| | | | | |
|---|---|---|---|---|
| 5,264,999 | A * | 11/1993 | Kempter | 362/342 |
| 5,528,478 | A * | 6/1996 | Degelmann | 362/290 |
| 5,758,954 | A * | 6/1998 | Holten et al. | 362/291 |
| 5,908,234 | A * | 6/1999 | Kreeft | 362/223 |
| 5,944,411 | A * | 8/1999 | Holten et al. | 362/342 |
| 6,582,099 | B1 * | 6/2003 | Bartenbach | 362/291 |
| 6,626,560 | B1 * | 9/2003 | Caferro et al. | 362/290 |

* cited by examiner

*Primary Examiner*—Sandra O'Shea
*Assistant Examiner*—Jason Han

(57) ABSTRACT

A luminaire has a plurality of reflecting lamellae between side reflectors. The lamellae each have an outer edge, an inner surface facing away from the outer edge, and a plane of symmetry through the outer edge and the inner surface. The lamellae have a resin body and a recess in the inner surface, in the plane of symmetry. The recess has a bottom surface transverse to the plane of symmetry and substantially parallel walls along said plane. The recess may widen stepwise from the bottom plane towards the inner surface. The lamellae, as compared with metal lamellae, provide a greater freedom to choose their shape and are less expensive. They nevertheless avoid the occurrence of reflections on the side reflectors, which cause unpleasant bright spots within the cut-off angle of the luminaire. A lamellae grid suitable for the luminaire has strips interconnecting, and integral with, the lamellae.

18 Claims, 3 Drawing Sheets

LUMINAIRE AND LAMELLAE GRID

The invention relates to a luminaire provided with:

side reflectors having a longitudinal direction and arranged in mirror symmetry on either side of a central plane;

a light emission window limited by the side reflectors and transverse to the central plane;

means for accommodating an elongate electric lamp in the longitudinal direction of the side reflectors in the central plane, remote from the light emission window;

a plurality of three-dimensional reflecting lamellae which extend transversely to the central plane between the side reflectors and are evenly distributed over the longitudinal direction thereof, which lamellae each have an outer edge adjacent the light emission window, an inner surface facing away from the outer edge, a plane of symmetry passing through the outer edge and the inner surface transversely to the longitudinal direction of the side reflectors, such that the inner surface encloses a decreasing angle with the central plane viewed in a direction from adjacent the central plane towards the side reflectors.

The invention also relates to a lamellae grid for such a luminaire, with:

a longitudinal direction;

a central plane;

a light emission window transverse to the central plane;

a plurality of three-dimensional reflecting lamellae which extend transversely to the central plane between the side reflectors and are evenly distributed over the longitudinal direction thereof, which lamellae each have an outer edge adjacent the light emission window, an inner surface facing away from the outer edge, a plane of symmetry passing through the outer edge and the inner surface transversely to the longitudinal direction, such that the inner surface encloses a decreasing angle with the central plane viewed in a direction from adjacent the central plane to further removed therefrom.

An embodiment of such a luminaire and lamellae grid is known from U.S. Pat. No. 5,758,954.

The known luminaire, when suspended from or mounted against a ceiling, is suitable for illuminating a space in which picture screens are used. It should be prevented here that unpleasant reflections arise on said screens. This is achieved by the known luminaire.

Owing to the location where a lamp, usually a tubular fluorescent lamp, is accommodated in the luminaire, there will be an angle sideways of the side reflectors with respect to the ceiling, from which angle the lamp cannot be observed, and in which angle, the cut-off angle, no unreflected rays are accordingly emitted by the luminaire. The side reflectors are designed for spreading the generated light evenly and for preventing that reflected light is radiated within the cut-off angle. The cut-off angle may have various values, depending on the requirements imposed, but it is usually at least 30°.

The lamellae have a similar function in the longitudinal lamp direction: cutting off and spreading. For this purpose, the two, usually concave reflective surfaces of the lamella should extend between the outer edge and the inner surface in a forward sloping direction. The outer edge is usually chosen to be as thin as possible so as to allow the light emission window to be as large and effective as possible. The slope of the reflective surfaces gives the inner surface a width. The lamellae are formed by stamping and bending from an optically high-grade metal plating, for example aluminum.

The incident light is reflected on the inner surface, so that light is incident on the side reflectors from a different angle than directly from the lamp. If the inner surface is planar and extends parallel to the ceiling, this light will be radiated within the cut-off angle owing to its different angle of incidence and will cause very bright light spots within the cut-off angle, which is inadmissible. To prevent the generation of these light spots within the cut-off angle, the lamellae of the known luminaire have inner surfaces which rise towards the side reflectors. The light reflected by the inner surfaces is then incident on the side reflectors at a different angle and in a location further away from the light emission window, with the result that the light is then radiated outside the cut-off angle by the side reflectors.

The lamellae in the known luminaire are connected to the side reflectors so as to form a grid.

It is a disadvantage of the known luminaire that, owing to their shape, the lamellae are larger than is necessary for spreading light and cutting off the lamp light. The large lamellae require much, comparatively expensive plate material of high quality. Even if the lamellae were to have a planar inner surface, they would still be expensive owing to their material consumption. Lamellae with no inner surface, but instead with straight inner edges, and accordingly open at the side facing the lamp, would indeed require much less material, but a considerable quantity of light would be incident inside the lamellae. This light would be reflected within the lamellae and finally be incident on the side reflectors at a different angle, thus creating inadmissible bright spots within the cut-off angle just as in the situation in which the inner surface is planar. It has been proposed to make lamellae which are open between their inner edges internally black so as to prevent reflections taking place within the lamellae. This, however, leads to an unacceptable loss of light.

Apart from the disadvantage that the known luminaire requires much comparatively expensive plate material for the lamellae, the known luminaire has the disadvantage that lamellae of metal plating impose restrictions on the shape of the lamellae, in particular on the shape of the reflective surfaces.

It is a first object of the invention to provide a luminaire of the kind described in the opening paragraph which has lamellae of a kind which allows a high degree of shape differentiation, which is comparatively inexpensive, and which nevertheless effectively counteracts the radiation of light within the cut-off angle.

It is a second object of the invention to provide a lamellae grid of the kind described in the second paragraph and designed for such a luminaire.

According to the invention, the first object is achieved in that the lamellae each have a body of synthetic resin, the inner surface has a recess in the plane of symmetry, which recess has a bottom surface transverse to the plane of symmetry with walls substantially parallel thereto and resting on said bottom surface.

Since the lamella bodies are made of synthetic resin, they can be manufactured in a mold, and a wide variety of shapes, such as curvatures of the reflective surfaces in longitudinal and transverse directions, can be realized. The recess in the inner surface not only achieves a saving in the material content of the lamella, but the material thickness of each lamella is also reduced, so that the operational time of the mold, i.e. the time during which the mold must remain closed and must be cooled until the lamella body has become fixed in its shape, is comparatively short. This reduces the cost price of the lamellae. Unpleasant reflections at the inner surface are avoided by the shape thereof, while the substantially parallel walls rising from the bottom counteract the emission of light which could cause glare within the cut-off angle.

The walls of the recess are substantially mutually parallel, but usually not perfectly parallel because the mold in which the lamella is manufactured must be capable of unmolding the product, i.e. a very small displacement relative to the lamella must lead to a creation of space in and around the lamella for it to be separated from the lamella In general, therefore, the walls will always enclose a very small angle of, for example, 1° with one another.

In a favorable embodiment, the bottom surface encloses a decreasing angle with the central plane viewed in a direction from adjacent the central plane towards the side reflectors. This embodiment has the advantage that the recess can be comparatively wide, so that even more material can be saved, and the material thicknesses can be even smaller, whereby the operational time of the mold is further shortened. The shape of the bottom surface, which is comparatively wide now, counteracts the reflection of light from the bottom surface to the side reflectors at unfavorable angles, but at the same time counteracts the loss of light in that the light is emitted to the exterior at favorable angles to the side reflectors.

In a modification of this embodiment, the recess widens stepwise towards the inner surface so as to form steps which extend substantially parallel to the bottom surface. In this modification, the lamellae have a further reduced material content and further reduced material thicknesses, while still effectively counteracting disadvantageous reflections, which is achieved by the shape of the steps which are substantially parallel to the bottom surface.

In another modification, a slit having a base is present in the bottom surface along the plane of symmetry. This slit may be so narrow that hardly any material is saved thereby. Nevertheless, such a slit is useful because the lamella has a smaller material thickness at the area of the slit than without a slit and can accordingly be cooled more quickly in that location.

To make this effect as strong as possible, it is favorable if the base is at least substantially parallel to the outer edge. The lamella will then in general have the same material thickness where the slit just ends, independently of the shape of the outer edge.

An attractive saving in material is realized in an embodiment wherein the inner surface deepens in steps towards the side reflectors. The angles enclosed by the inner surface and the central plane need not be substantially different at the area of the steps compared with the absence thereof Similarly, the height differences in the lamellae may be steps.

In a special embodiment, a slit is present in the bottom surface along the plane of symmetry S, which slit extends into the outer edge so as to form an at least substantially two-part lamella In this embodiment, therefore, the lamella is open from the inner surface right through to the outer edge. This embodiment has the advantage that light entering the slit can emerge at the outer edge. It is counteracted thereby that light is lost in the slit owing to multiple reflections. Light will issue from the slit to the exterior parallel to the plane of symmetry or at a small angle thereto. Light thus directed requires no change of direction at reflective surfaces because it is radiated outside the cut-off angle. The value of the angle to the plane of symmetry at which light issues from the slit to the exterior depends on the width of the slit.

The slit may divide the lamella entirely or substantially into two parts. In the latter case, synthetic resin may be present adjacent the outer edge, for example adjacent the side reflectors, or in or adjacent the central plane, interconnecting the parts of the lamella so as to give the lamella sturdiness, permanence of shape, or a defined position.

The outer edge of the lamella may be of various shapes, for example straight. It is alternatively favorable for an even cutting-off of light radiated in the central plane and in surfaces at an acute angle to the central plane if the outer edge is concave in the plane of symmetry of the lamella. An unnecessarily strong cutting off in the central plane and in adjacent planes is avoided thereby. The lamellae may be formed, for example, from polycarbonate (PC), polystyrene (PS), polycarbonate.acrylonitrilbutadienestyrene (PC.ABS). They may have a mirroring coating of, for example, aluminum.

The side reflectors may be separate bodies. Alternatively, they may form part of a concave reflector which extends laterally of an accommodated lamp, around the lamp up to the other side of the lamp. The luminaire may also have a housing in which the side reflectors, the means for accommodating the lamp, and the lamellae are present. A portion of the housing situated opposite the light emission window may itself be a reflector, for example in that it is lacquer-coated. Light radiated between separate side reflectors against this portion of the housing will then be reflected by this portion. It is also possible that the luminaire is open also opposite the light emission window so as to radiate a secondary light beam, for example for indirect lighting. These possibilities are included in the luminaire according to the invention because they make no difference for the object of the invention and the realization thereof.

The side reflectors may be, for example, of aluminum. They will generally be semi-high-mirroring, but they may alternatively be high-mirroring or frosted.

The luminaire according to the invention may be designed for accommodating, for example, a straight, tubular fluorescent lamp. Alternatively, the luminaire may be suitable for accommodating, for example, a fluorescent lamp comprising several, for example two parallel tubular lamp vessel portions, or for accommodating more than one tubular lamp. The luminaire may furthermore be constructed as a multiple luminaire, i.e. with more than one pair of side reflectors, among other possibilities.

The second object of the invention is realized in that the lamellae each have a body of synthetic resin, the inner surface has a recess in the plane of symmetry with a bottom surface transverse to the plane of symmetry and substantially parallel walls resting on said bottom surface, and the lamellae are interconnected by strips which extend in longitudinal direction and which are integral with the lamellae.

An embodiment of the luminaire according to the invention is shown in the drawing, in which.

Figure 1:
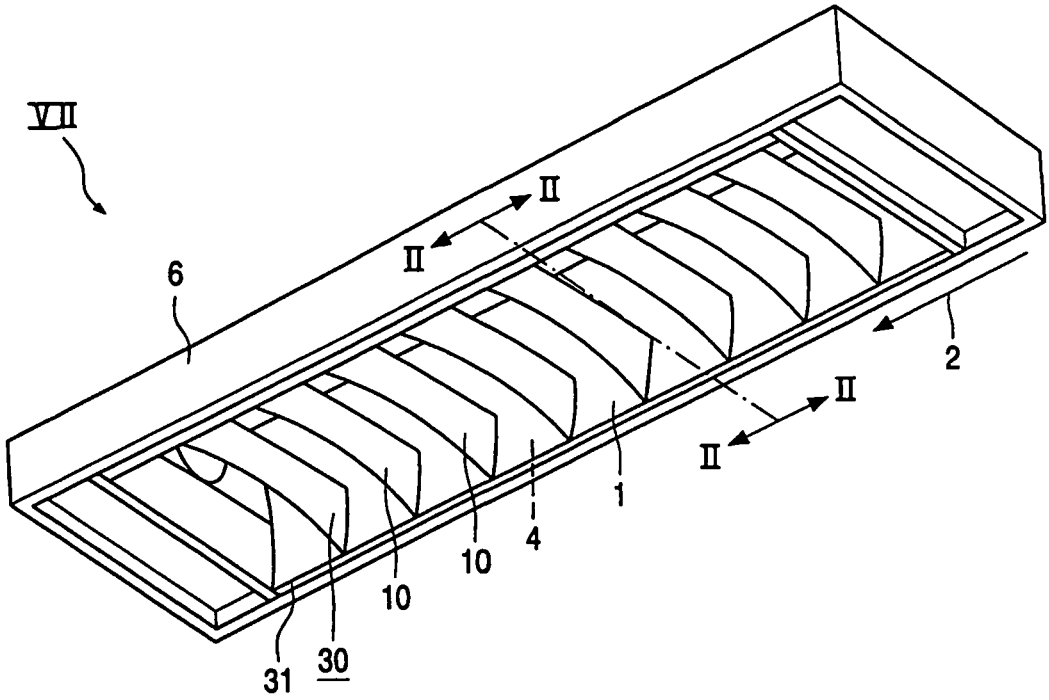
FIG. 1 shows the luminaire diagrammatically and in perspective view.
Figure 7:
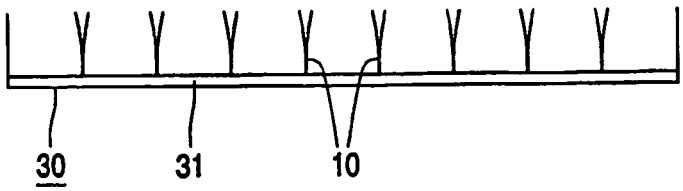

FIG. 7 diagrammatically shows the lamellae grid viewed along VII in FIG. 1.

Figure 2:
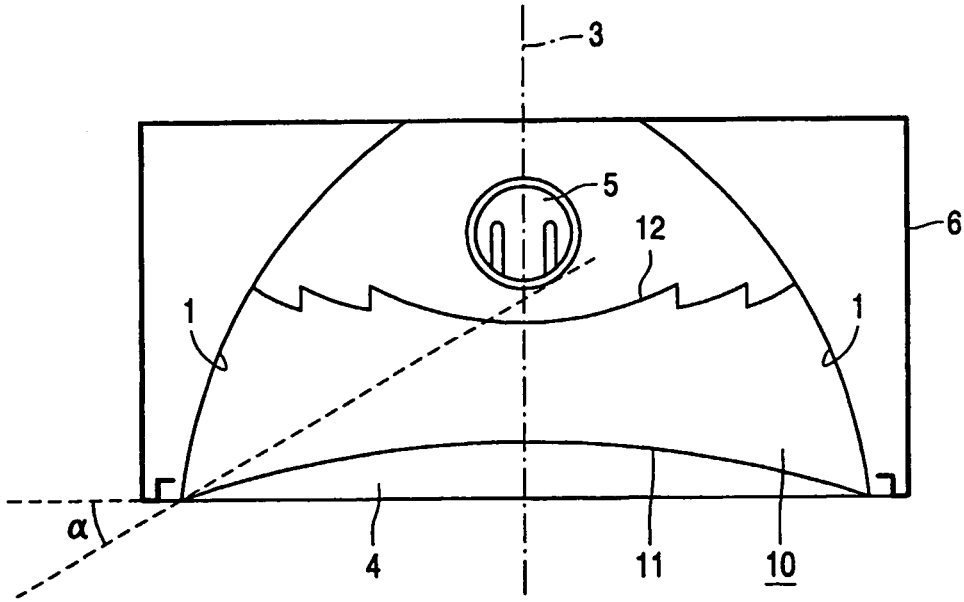
FIG. 2 is a cross-section taken on the line II—II in FIG. 1.

In FIGS. 1 and 2, the luminaire is provided with side reflectors 1 having a longitudinal direction 2 and arranged in mirror symmetry on either side of a central plane 3. A light emission window 4 is limited by the side reflectors 1, and is directed transversely to the central plane 3. Means 5 are present for accommodating an elongate electric lamp in the central plane 3 in the longitudinal direction 2 of the side reflectors 1, remote from the light emission window 4. The means 5 are suitable for accommodating a straight, tubular low-pressure mercury vapor discharge lamp provided with a fluorescent substance. Two identical cross-sections as shown in FIG. 2 are present in the sectional plane II—II in FIG. 1. The means in the embodiment shown are accordingly in two parts. A plurality of three-dimensional reflecting lamellae 10 extend transversely to the central plane 3 between the side reflectors 1, evenly distributed over the longitudinal direction 2 thereof. The cut-off angle a within which no unreflected light can be radiated and no reflected light is allowed to be radiated is indicated.

The luminaire has a housing 6.

Figure 3:
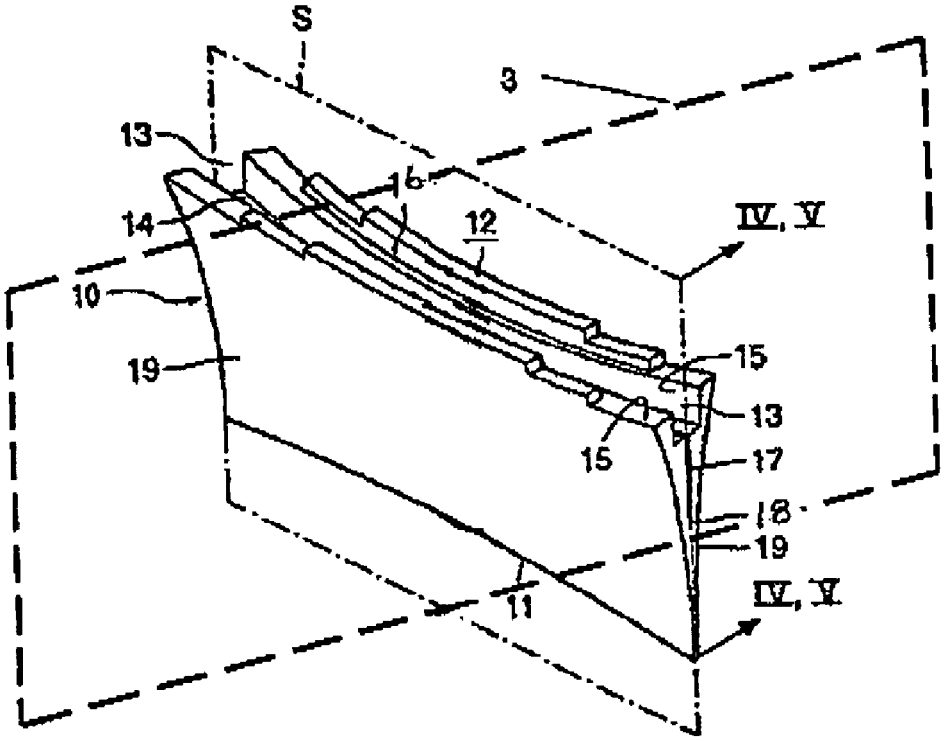
FIG. 3 shows the lamella used in FIGS. 1 and 2 in perspective view.

The lamellae 10, see also FIG. 3, each have an outer edge 11 adjacent the light emission window 4, an inner surface 12 remote from the outer edge 11, and a plane of symmetry S passing through the outer edge 11 and the inner surface 12 and transverse to the longitudinal direction 2 of the side reflectors 1. The inner surface 12 encloses a decreasing angle with the central plane 3 viewed in a direction from adjacent the central plane 3 towards the side reflectors 1.

The lamellae 10 have reflective surfaces 19 between the outer edge 11 and the inner surface 12, which surfaces provide a cut-off in the longitudinal direction 2 and spread incident light. In the luminaire according to the invention, the designer has a greater degree of freedom for shaping these surfaces 19.

The lamellae 10 have a body of synthetic resin, of polycarbonate in the embodiment shown. The lamellae 10 are coated on all sides with mirroring aluminum. The inner surface 12 has a recess 13 in the plane of symmetry S, which recess has a bottom surface 14 transverse to the plane of symmetry S and substantially parallel walls 15 resting on said surface.

The lamellae 10 form a grid 30 together with strips which are integral with the lamellae 10.

Figure 4:
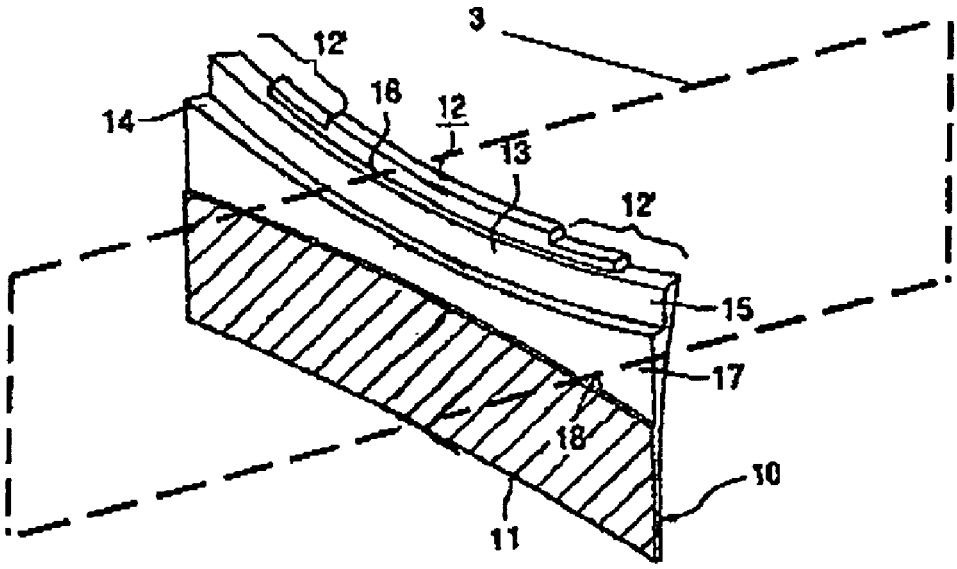
FIG. 4 is a cross-section of the lamella taken on the line IV—IV in FIG. 3.

The bottom surface 14 encloses a decreasing angle with the central plane 3 from adjacent the central plane 3 towards the side reflectors 1, see FIG. 4.

The recess 13 widens stepwise towards the inner surface 12 so as to form steps 16 which are substantially parallel to the bottom surface 14. In FIG. 4, one step is formed each time laterally of the plane of symmetry S, but a greater number of steps may alternatively be present in one and the same lamella. The recess 13 may be deeper, for example, and furthermore a step 16 may be made the moment the thickness of the walls 15, starting from a minimum value necessary for ensuring a permanency of shape of the lamella 10, for example 1 or 1.2 mm, has reached a chosen greater thickness value, for example a value 0.1 or 0.2 mm greater, viewed in a direction from the bottom surface 14 towards the inner surface 12. The recess 13 may thus have a ribbed structure on either side of the plane of symmetry S.

A slit 17 with a base 18 is present in the bottom surface 14, along the plane of symmetry S.

The base 18 is at least substantially parallel to the outer edge 11.

The inner surface 12 deepens stepwise towards the side reflectors 1, so that the inner surface 12 has stepped portions 12'.

Figure 5:
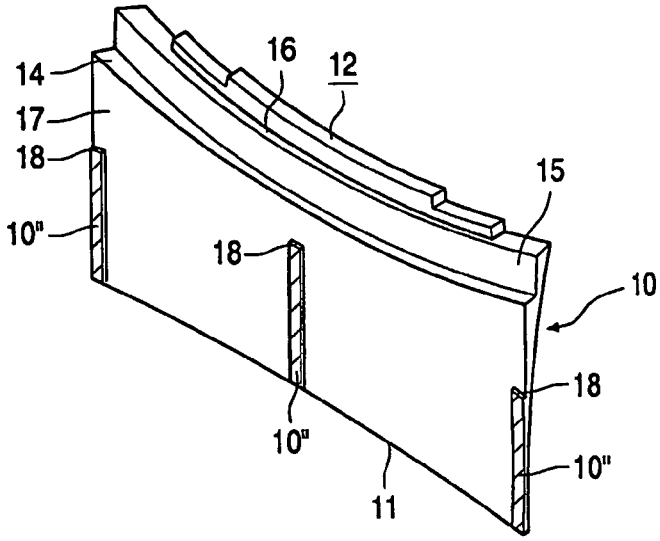
FIG. 5 is a cross-section of a modification of the lamella of FIG. 3, taken in an analogous manner on the line V—V in FIG. 3.
Figure 6:
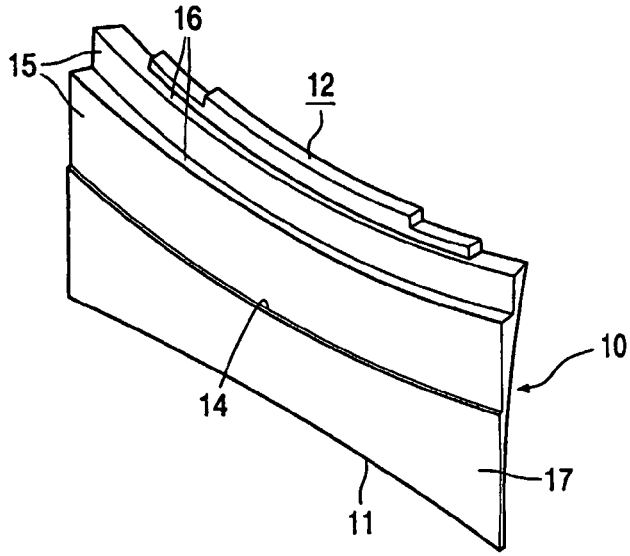
FIG. 6 shows part of a two-part lamella viewed as in FIG. 4.

In FIGS. 5 and 6, reference numerals have the same meanings as in the preceding Figures.

In FIG. 5, a slit 17 is present in the bottom surface 14 along the plane of symmetry S, which slit extends into the outer edge 11 so as to form a substantially two-part lamella 10. Ribs 10", forming parts of the synthetic resin body of the lamella 10, are retained, as are portions of the base 18, thus interconnecting the two mirrored parts of the lamella 10.

In FIG. 6, a slit 17 extends in the bottom surface 14 along the plane of symmetry S into the outer edge 11 so as to form a two-part lamella 10. The bottom surface 14 lies deeper in the lamella 10 than in the preceding Figures, and the lamella 10 has one step 16 more. The two parts of the lamella 10 may be located further apart, if so desired, though still in one another's vicinity, so as to allow a greater quantity of light to pass through the slit.

In FIG. 7, the reference numerals have the same meanings as in the preceding Figures. The lamellae grid 30 has strips 31, see also FIG. 1, which are integral with the lamellae 10 and which interconnect the lamellae 10.

The invention claimed is:

1. A luminaire comprising;

side reflectors on either side of a central plane, the side reflectors opposing each other along a longitudinal direction;

a light emission window bounded by the side reflectors in a direction transverse to the central plane;

an opening in the luminaire capable of accommodating an electric lamp elongated in the longitudinal direction, the opening being opposite and extending substantially parallel to the light emission window; and two or more reflective lamellae transverse to the central plane, between the side reflectors and evenly spaced in the longitudinal direction, the lamellae each having an outer edge adjacent the light emission window, an inner surface facing away from the outer edge and a plane of symmetry (S) passing through the outer edge and the inner surface transversely to the longitudinal direction, the inner surface having a recess with walls parallel to the plane of symmetry (S), the recess having a bottom surface transverse to the plane of symmetry (S), the walls resting on the bottom surface.

2. The luminaire of claim 1, wherein tangent lines drawn to successive points on the inner surface in a direction progressing transversely from the central plane toward a one of the side reflectors make a decreasing angle from the central plane.

3. The luminaire of claim 1, wherein the lamellae each have a body of synthetic resin.

4. The luminaire of claim 1, wherein tangent lines drawn to successive points on the bottom surface in a direction progressing transversely from the central plane toward a one of the side reflectors make a decreasing angle from the central plane.

5. The luminaire of claim 1, wherein the recess widens stepwise towards the inner surface so as to form steps which extend substantially parallel to the bottom surface.

6. The luminaire of claim 1, wherein a slit having a base is present in the bottom surface along the plane of symmetry (S).

7. The luminaire of claim 6, wherein the base is at least substantially parallel to the outer edge.

8. The luminaire of claim 1, wherein the inner surface deepens in steps as it rises toward the side reflectors.

9. The luminaire of claim 1, wherein a slit is present in the bottom surface along the plane of symmetry, the slit extending into the outer edge so as to form an at least substantially two-part lamella.

10. A luminaire comprising:

side reflectors having a longitudinal direction and arranged in mirror symmetry on either side of a central plane;

a light emission window limited by the side reflectors and transverse to the central plane;

means for accommodating an elongate electric lamp in the longitudinal direction of the side reflectors in the central plane, remote from the light emission window;

a plurality of three-dimensional reflecting lamellae, each of the lamellae extending transversely to the central plane between the side reflectors and the lamellae being evenly distributed over the longitudinal direction thereof, the lamellae (10) each having an outer edge (11) adjacent the light emission window, an inner surface facing away from the outer edge, a plane of symmetry (S) passing through the outer edge and the inner surface transversely to the longitudinal direction of the side reflectors, at least a portion of the inner surface curving toward at least one of the side reflector(s) and curving away from a line perpendicular to central plane, wherein the lamellae each have a body of synthetic resin, the inner surface has a recess in the plane of symmetry (S), which recess has a bottom surface transverse to the plane of symmetry (S) with walls substantially parallel thereto and resting on said bottom surface.

11. The luminaire of claim 10, wherein at least a portion of the bottom surface curves toward at least one of the side reflectors and away from a line perpendicular to the central plane.

12. The luminaire of claim 10, wherein the recess widens stepwise towards the inner surface so as to form steps which extend substantially parallel to the bottom surface.

13. The luminaire of claim 10, wherein a slit having a base is present in the bottom surface along the plane of symmetry (S).

14. The luminaire of claim 13, wherein the base is at least substantially parallel to the outer edge.

15. The luminaire of claim 10, wherein the inner surface deepens in steps towards the side reflectors.

16. The luminaire of claim 10, wherein a slit is present in the bottom surface along the plane of symmetry (S), which slit extends into the outer edge so as to form an at least substantially two-part lamella.

17. A lamellae grid for a luminaire of claim 10 wherein at least two of the lamellae are interconnected by strips which extend in the longitudinal direction and which are integral with the lamellae.

18. The luminaire of claim 10, wherein the side reflectors are portions of a concave reflector.

* * * * *